US009401556B2

(12) United States Patent
Tsugawa et al.

(10) Patent No.: US 9,401,556 B2
(45) Date of Patent: Jul. 26, 2016

(54) CONNECTOR

(71) Applicant: Japan Aviation Electronics Industry, Limited, Tokyo (JP)

(72) Inventors: Sae Tsugawa, Tokyo (JP); Kazuomi Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/703,071

(22) Filed: May 4, 2015

(65) Prior Publication Data

US 2016/0006153 A1 Jan. 7, 2016

(30) Foreign Application Priority Data

Jul. 1, 2014 (JP) ..... 2014-136009

(51) Int. Cl.

| | |
|---|---|
| ***H01R 13/03*** | (2006.01) |
| ***C25D 5/10*** | (2006.01) |
| ***H01R 13/26*** | (2006.01) |
| ***H01R 24/66*** | (2011.01) |
| *H01R 13/11* | (2006.01) |

(52) U.S. Cl.

CPC *H01R 13/03* (2013.01); *C25D 5/10* (2013.01); *H01R 13/26* (2013.01); *H01R 24/66* (2013.01); *H01R 13/112* (2013.01)

(58) Field of Classification Search

CPC ..... H01R 13/03; H01R 24/66; H01R 13/26
USPC ..... 439/886, 65, 66
See application file for complete search history.

(56) References Cited

U.S. PATENT DOCUMENTS

| | | | | |
|---|---|---|---|---|
| 7,484,969 | B2 * | 2/2009 | Shiu | H01R 12/716 439/660 |
| 2003/0186597 | A1 | 10/2003 | Suzuki et al. | |
| 2004/0229077 | A1 * | 11/2004 | Mori | B32B 15/017 428/647 |
| 2005/0176267 | A1 | 8/2005 | Saitoh | |
| 2006/0260678 | A1 | 11/2006 | Nagao et al. | |
| 2011/0162707 | A1 * | 7/2011 | Schuisky | C23C 14/08 136/256 |
| 2015/0079422 | A1 | 3/2015 | Sunaga et al. | |

FOREIGN PATENT DOCUMENTS

| | | | |
|---|---|---|---|
| EP | 0 875 960 | A1 | 11/1998 |
| JP | 2003-181976 | A | 7/2003 |

(Continued)

OTHER PUBLICATIONS

Extended European Search Report dated Nov. 26, 2015 in European Application No. 15174851.4.

*Primary Examiner* — Tulsidas C Patel
*Assistant Examiner* — Marcus Harcum
(74) *Attorney, Agent, or Firm* — Collard & Roe, P.C.

(57) ABSTRACT

A connector is mateable with a mating connector which includes a mating contact having a mating contact point. The connector comprises a contact and a holding member which holds the contact. The contact has a contact portion. When the connector and the mating connector are mated with each other, the mating contact point slides on and is in contact with the contact portion. The contact portion has a first plated layer as its outermost layer and a second plated layer located under the first plated layer. The first plated layer is made of silver or silver alloy and has Vickers hardness not more than 90 Hv. The second plated layer is made of silver or silver alloy and has Vickers hardness not less than 100 Hv.

5 Claims, 6 Drawing Sheets

(56) References Cited

FOREIGN PATENT DOCUMENTS

| | | | |
|---|---|---|---|
| JP | 2008-169408 | A | 7/2008 |
| JP | 2013-189680 | A | 9/2013 |
| JP | 2013-231228 | A | 11/2013 |
| JP | 2014-005549 | A | 1/2014 |
| JP | 2014-095139 | A | 5/2014 |

* cited by examiner

CONNECTOR

CROSS REFERENCE TO RELATED APPLICATIONS

An applicant claims priority under 35 U.S.C. §119 of Japanese Patent Application No. JP2014-136009 filed Jul. 1, 2014.

BACKGROUND OF THE INVENTION

This invention relates to a connector which comprises a contact having a silver-plated layer.

For example, JP-A 2014-095139 (Patent Document 1) discloses a layered product which is applicable to a contact of a connector, the content of Patent Document 1 is incorporated herein by reference.

As shown in FIG. 12, the layered product of Patent Document 1 comprises a first silver-plated layer as its outermost layer thereof, a second silver-plated layer located under the first silver-plated layer and a base metal located under the second silver-plated layer. The second silver-plated layer is formed on a surface of the base metal, and the first silver-plated layer is formed on a surface of the second silver-plated layer. The second silver-plated layer has Vickers hardness lower than that of the first silver-plated layer by 30 HV or more. This layered product is superior in abrasion resistance because the first silver-plated layer has high Vickers hardness. Moreover, this layered product is superior in formability because this layered product includes the second silver-plated layer which is located under the first silver-plated layer, softer than the first silver-plated layer and therefore absorbs stress under bending.

However, a contact of a connector is required to also have reduced contact resistance.

SUMMARY OF THE INVENTION

It is therefore an object of the present invention to provide a connector comprises a contact having low contact resistance.

One aspect of the present invention provides a connector mateable with a mating connector which includes a mating contact having a mating contact point. The connector comprises a contact and a holding member which holds the contact. The contact has a contact portion. When the connector and the mating connector are mated with each other, the mating contact point slides on and is in contact with the contact portion. The contact portion has a first plated layer as its outermost layer and a second plated layer located under the first plated layer. The first plated layer is made of silver or silver alloy and has Vickers hardness not more than 90 Hv. The second plated layer is made of silver or silver alloy and has Vickers hardness not less than 100 Hv.

When a plated layer is made only of silver or made of silver alloy which contains no antimony (Sb), no selenium (Se) and no tellurium (Te) each of which causes high contact resistance, the plated layer has Vickers hardness not more than 90 Hv. Since the first plated layer, which is thus made to have Vickers hardness not more than 90 Hv, is provided as the outermost layer, the contact resistance of the contact can be lowered.

The first plated layer has relatively low abrasion resistance. Accordingly, when the connector is repeatedly inserted into and removed from the mating connector, the layer under the first plated layer might be exposed. However, extreme increase in contact resistance can be avoided even in this case because the second plated layer is provided under the first plated layer.

In addition, since the second plated layer has high abrasion resistance, the layer under the second plated layer can be prevented from being exposed to further make the contact resistance higher.

An appreciation of the objectives of the present invention and a more complete understanding of its structure may be had by studying the following description of the preferred embodiment and by referring to the accompanying drawings.

Figure 1:
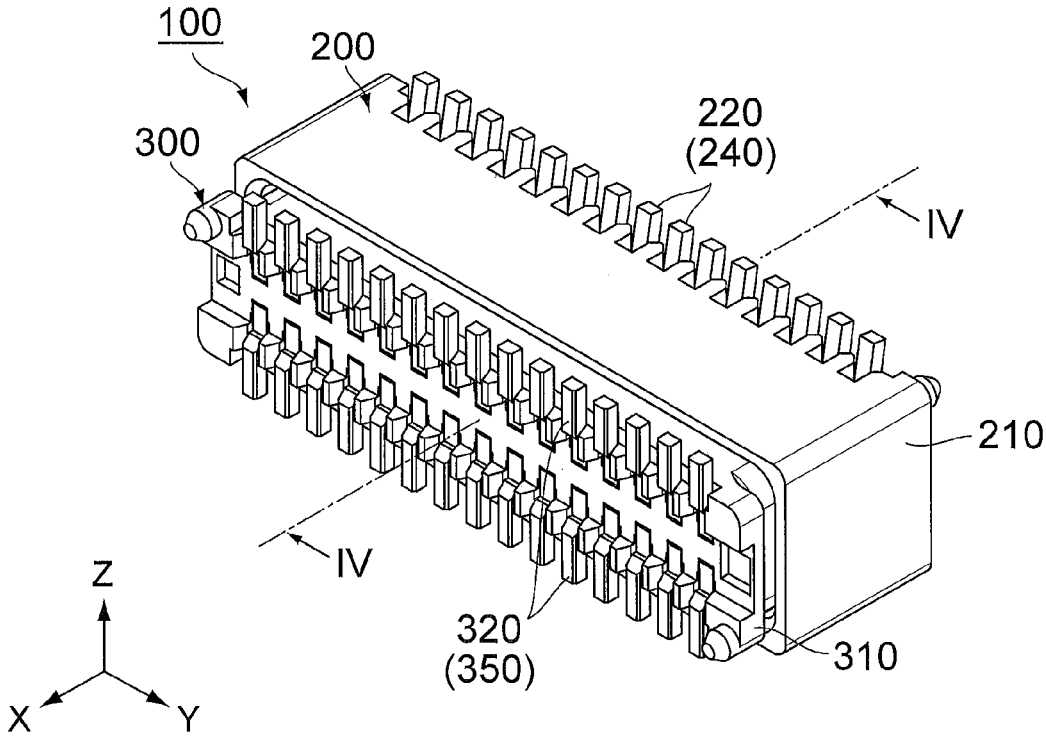
FIG. 1 is a perspective view showing a connector pair consisting of a connector and a mating connector according to a first embodiment of the present invention, wherein the connector and the mating are mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS (First Embodiment)

As shown in FIGS. 1 to 4, a connector pair 100 according to a first embodiment of the present invention comprises a connector 200 and a mating connector 300 which are mateable with each other along the X-direction (front-rear direction: predetermined direction). In the present embodiment, each of the connector 200 and the mating connector 300 is an on-board connector that is to be mounted on a circuit board (not-shown). However, the present invention is applicable to a connector other than the on-board connector.

Figure 2:
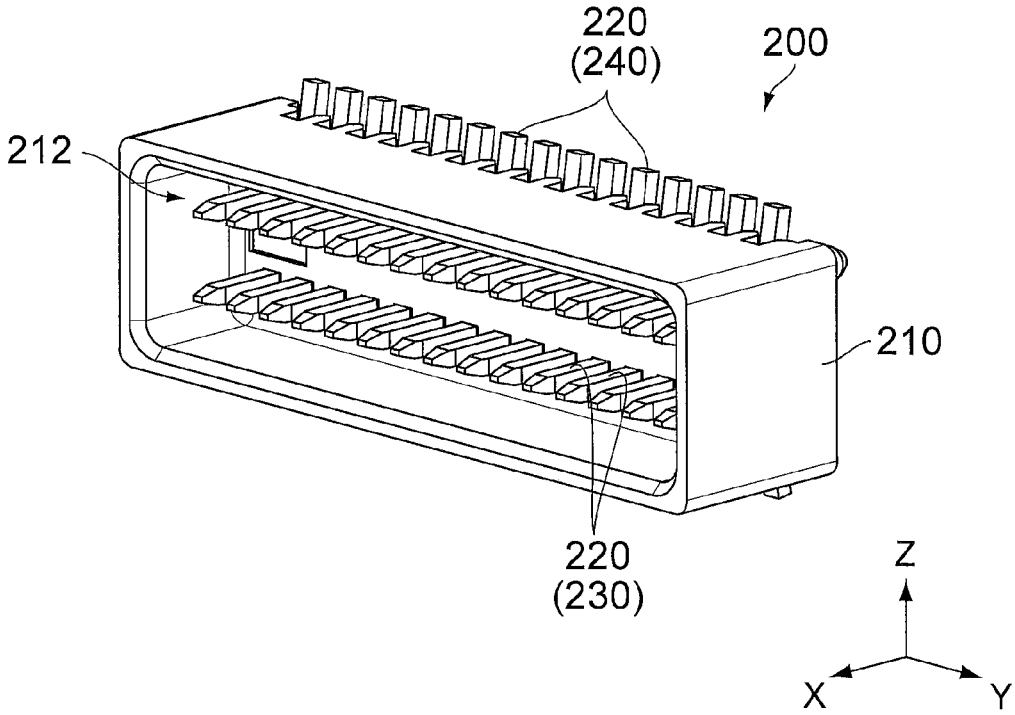
FIG. 2 is a perspective view showing the connector of FIG. 1.

As shown in FIG. 2, the connector 200 includes a holding member 210 made of insulator and a plurality of contacts 220 each made of conductor. The holding member 210 has a box-like shape extending long in the Y-direction (pitch direction). The holding member 210 has a receiving portion 212 formed therewithin. The contacts 220 are held by the holding member 210. In detail, the contacts 220 are separated into two rows in the Z-direction (upper-lower direction). The contacts 220 in each row are arranged in the Y-direction.

Figure 4:
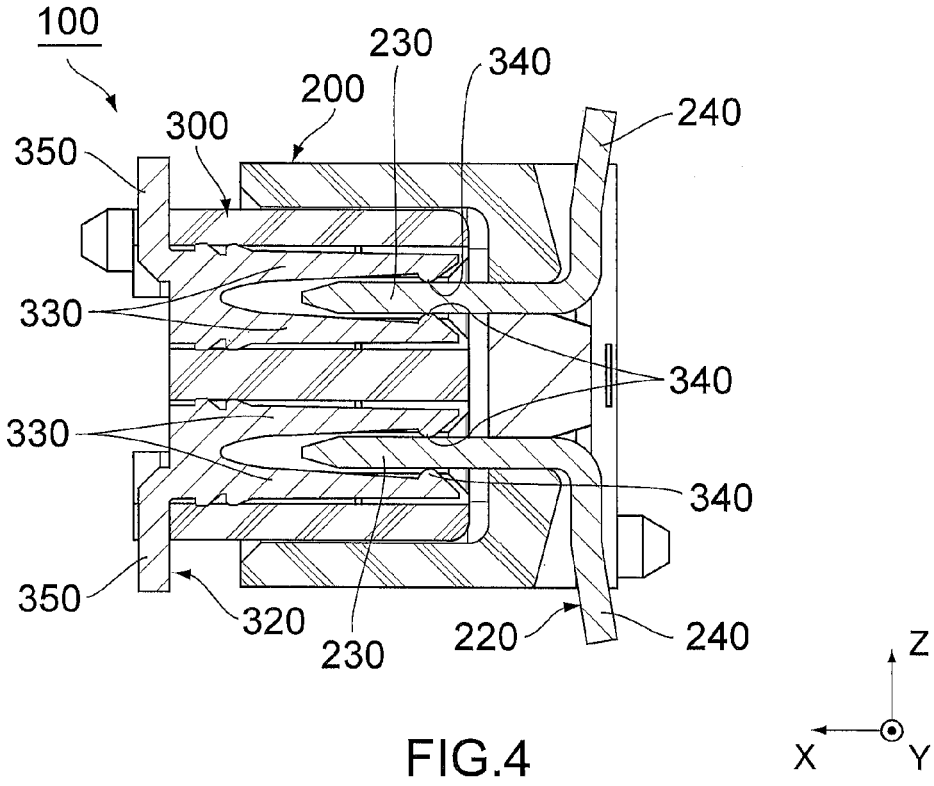
FIG. 4 is a cross-sectional view showing the connector pair of FIG. 1, taken along line IV-IV.

As shown in FIGS. 2 and 4, each of the contacts 220 according to the present embodiment has a contact portion 230 and a fixed portion 240. The contact portion 230 extends along the X-direction in the receiving portion 212. The contact portion 230 according to the present embodiment has an upper surface (positive Z-side surface) and a lower surface (negative Z-side surface) which extend in the XY-plane. The fixed portion 240 extends outward in the Z-direction from about the negative X-side end (rear end) of the contact portion 230. When the connector 200 is mounted on a circuit board (not shown), the fixed portion 240 is fixed and connected to the circuit board by soldering or the like.

Figure 5:
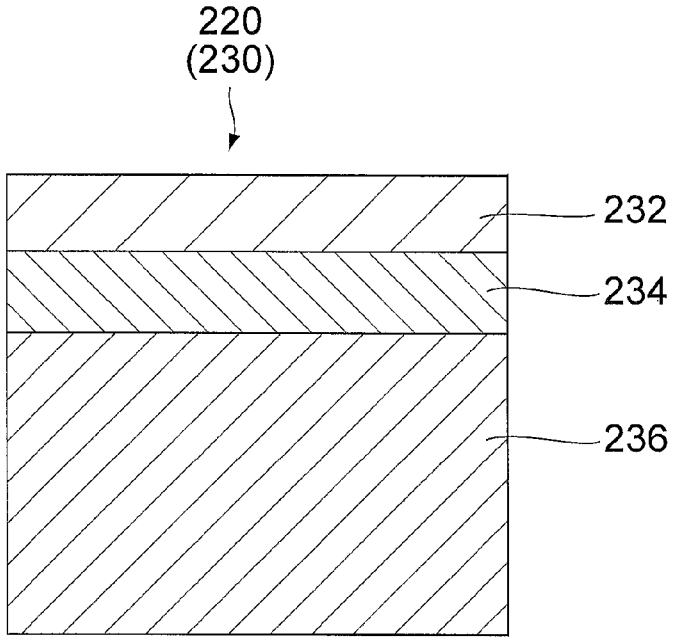
FIG. 5 is a cross-sectional view showing detail structure of a contact portion shown in FIG. 2.

As shown in FIG. 5, the contact portion 230 of the contact 220 is double plated, or has a double layered plate. The double layered plate may be evenly formed on the whole contact 220 or may be formed only on the contact portion 230.

In detail, the contact portion 230 has a first plated layer 232 as its outermost layer, a second plated layer 234 located under the first plated layer 232 and a base member 236 located under the second plated layer 234. In other words, the contact portion 230 has the base member 236, the second plated layer 234 formed on the base member 236 and the first plated layer 232 formed on the second plated layer 234. The contact portion 230 may further have an underlying plated layer interposed between the base member 236 and the second plated layer 234.

In the present embodiment, the base member 236 is made of copper or copper alloy. However, the present invention is not limited thereto. The base member 236 may be made of metal other than copper and copper alloy.

The second plated layer 234 is made of silver or silver alloy and has Vickers hardness not less than 100 Hv. In particular, the Vickers hardness of the second plated layer 234 of the present embodiment is not more than 180 Hv. However, the present invention is not limited thereto. The Vickers hardness of the second plated layer 234 may be not less than 180 Hv. Moreover, the second plated layer 234 of the present embodiment is made of silver alloy which contains silver and selenium (Se) added as hardener. The second plated layer 234 contains silver of 90 wt. % or more, and a remaining part is made of selenium. However, the present invention is not limited thereto. The second plated layer 234 may contain, as the remaining part other than the silver, at least one element selected from the group consisting of antimony (Sb), selenium (Se) and tellurium (Te).

The first plated layer 232 is made of silver or silver alloy and has Vickers hardness not more than 90 Hv. The first plated layer 232 of the present embodiment contains no antimony, no selenium and no tellurium, that causes the Vickers hardness of the first plated layer 232 to be low, specifically not more than 90 Hv. As can be seen from the above description, the first plated layer 232 of the present embodiment is softer than the second plated layer 234.

Figure 3:
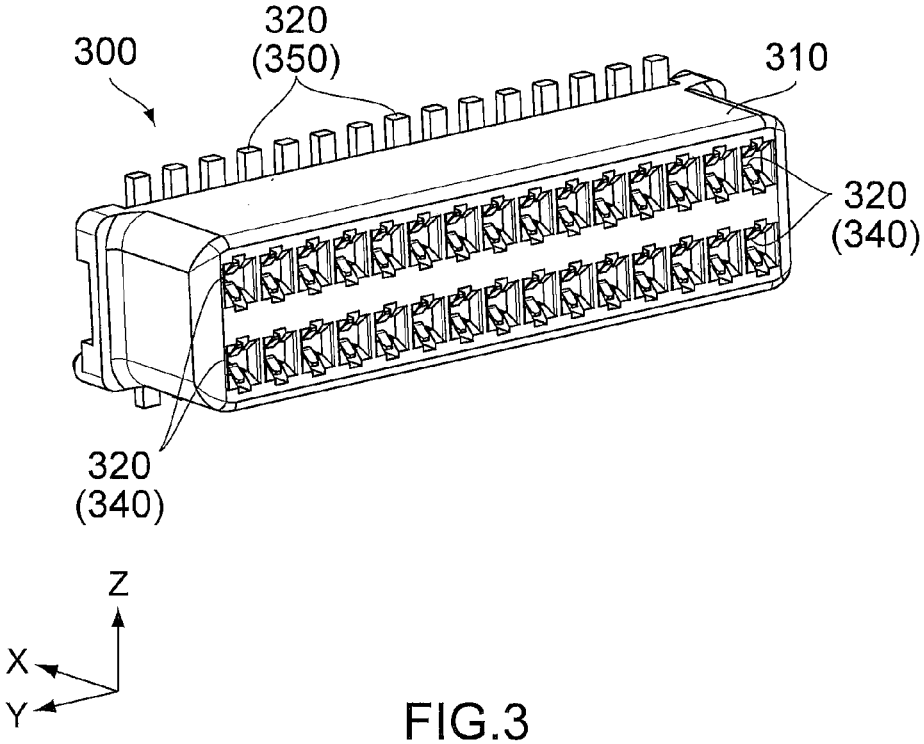
FIG. 3 is a perspective view showing the mating connector of FIG. 1.

As shown in FIG. 3, the mating connector 300 includes a mating holding member 310 made of insulator and a plurality of mating contacts 320 each made of conductor. The mating holding member 310 has a box-like shape extending long in the Y-direction (pitch direction). The mating contacts 320 are held by the mating holding member 310 so as to correspond to the contacts 220 (see FIG. 2), respectively. In detail, the mating contacts 320 are separated into two rows in the Z-direction (upper-lower direction). The mating contacts 320 in each row are arranged in the Y-direction.

Referring to FIGS. 3 and 4, each of the mating contacts 320 according to the present embodiment has two resiliently supporting portions 330, two mating contact points 340 and a fixed portion 350. The resiliently supporting portions 330 extend along the X-direction. Each of the mating contact points 340 has a projecting shape. The mating contact points 340 are supported by the resiliently supporting portions 330, respectively. Each of the resiliently supporting portions 330 is resiliently deformable in the XZ-plane. Accordingly, each of the mating contact points 340 is movable in the Z-direction. The fixed portion 350 extends outward in the Z-direction from the vicinity of the positive X-side end (rear end) of one of the resiliently supporting portions 330. When the mating connector 300 is mounted on a circuit board (not shown), the fixed portion 350 is fixed and connected to the circuit board by soldering or the like.

As shown in FIG. 4, the two mating contact points 340 of each of the mating contacts 320 face each other in the Z-direction. Each of the mating contact points 340 is plated similar to the aforementioned contact portion 230. However, the present invention is not limited thereto. The mating contact point 340 may be plated differently from the aforementioned contact portion 230. For example, only the contact 220 or only the contact portion 230 of the contact 220 may be double plated as previously described, while the mating contact point 340 of the mating contact 320 may be formed with a single layered plate.

As can be seen from FIG. 4, when the connector 200 and the mating connector 300 are mated with each other, each of the mating contact points 340 is moved while sliding on the contact portion 230 along the X-direction (predetermined direction). In the present embodiment, when the connector 200 and the mating connector 300 are mated with each other, the projecting shape of the mating contact point 340 intersects with the X-direction and is in contact with the contact portion 230. In other words, the mating contact point 340 has a shape which projects toward the contact portion 230 in a direction intersecting with the X-direction.

In the aforementioned case where the mating contact point 340 is moved while sliding on the contact portion 230, contact resistance between the contact portion 230 and the mating contact point 340 is changed mainly depending on plated structure of the contact portion 230. In the present embodiment, the first plated layer 232, which is the outermost layer, has the Vickers hardness not more than 90 Hv and is made of silver or silver alloy. In other words, the first plated layer 232 of the present embodiment contains no hardener, such as antimony, selenium or tellurium, which causes high contact resistance. Accordingly, the contact resistance between the contact portion 230 and the mating contact point 340 can be lowered. In addition, since the second plated layer 234 and the base member 236 are substantially wrapped by the first plated layer 232, the selenium contained in the second plated layer 234, the copper contained in the base member 236 or the like can be prevented from being exposed on the outermost surface of the contact portion 230.

In general, when the contact 220 of the connector 200 is repeatedly and many times inserted into and removed from the mating contact 320 of the mating connector 300, the first plated layer 232 might be abraded to expose the second plated layer 234. According to the present embodiment, although the second plated layer 234 is made of material having contact resistance higher than that of other material of the first plated layer 232, the material of the second plated layer 234 has relatively low contact resistance in comparison with general material. Accordingly, even if the second plated layer 234 is exposed, extreme increase in contact resistance can be avoided. In particular, the Vickers hardness of the second plated layer 234 of the present embodiment is not more than 180 Hv. Accordingly, even when the contact resistance increases, the contact resistance can be kept relatively low. In addition, since the Vickers hardness of the second plated layer 234 is not less than 100 Hv, the second plated layer 234 has superior abrasion resistance. Accordingly, the possibility of exposure of the base member 236 can be lowered as compared with a case where only the first plated layer 232 is provided.

In the aforementioned embodiment, the contact portion 230 has a rectangular rod-like shape. However, the contact portion 230 may have a plate-like shape or a round rod-like shape. In other words, the contact 220 may have any shape. Similarly, the mating contact 320 may have any shape.

(Second Embodiment)

Figure 6:
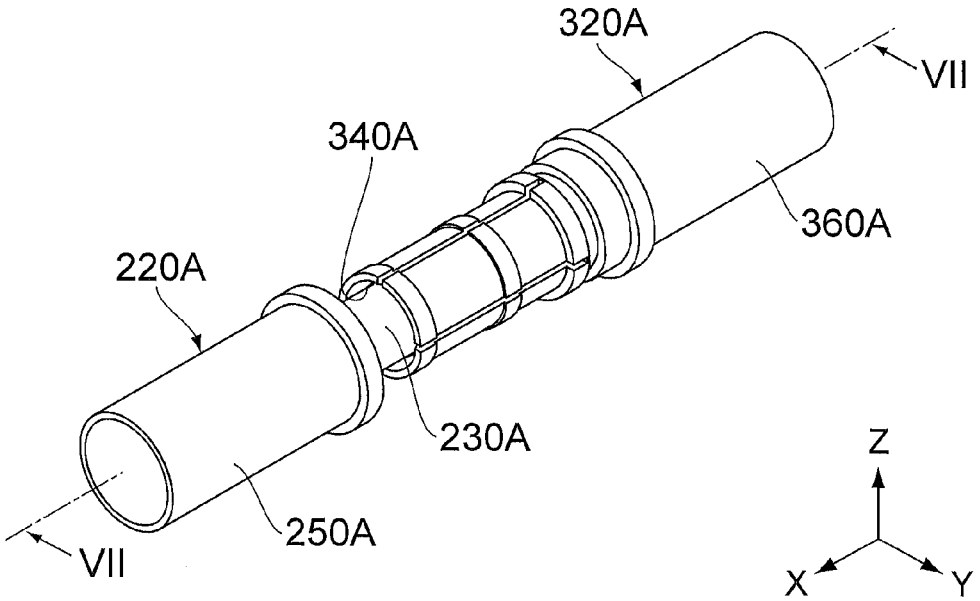
FIG. 6 is a perspective view showing a contact and a mating contact according to a second embodiment of the present invention, wherein the contact is inserted in the mating contact.
Figure 7:
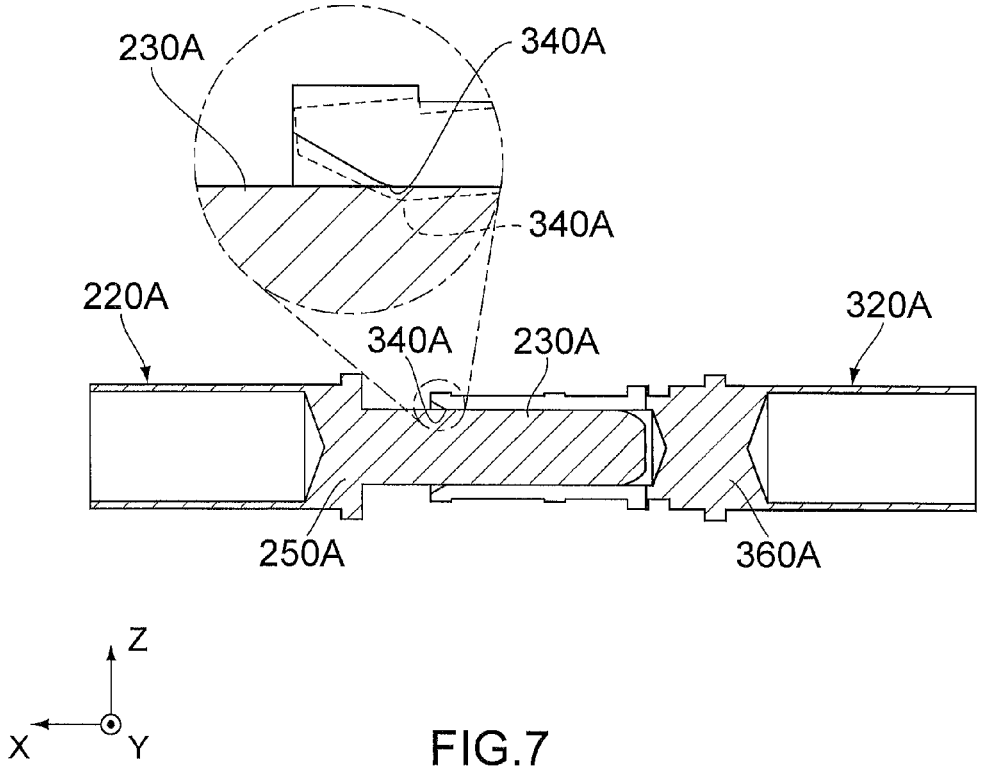
FIG. 7 is a cross-sectional view showing the contact and the mating contact of FIG. 6, taken along line VII-VII, wherein the vicinity of a contact portion (the part encircled by chain dotted line) is enlarged to be illustrated, and an outline of a mating contact point prior to the insertion of the contact into the mating contact is illustrated by dotted line.

Referring to FIGS. 6 and 7, a connector pair (not shown) according to a second embodiment of the present invention comprises a connector (not shown) and a mating connector (not shown) mateable with each other. The connector includes a contact 220A made of conductive material, and the mating connector includes a mating contact 320A made of conductive material.

As shown in FIGS. 6 and 7, the contact 220A according to the present embodiment has a contact portion 230A and a base portion 250A. The contact portion 230A extends along the negative X-direction from the base portion 250A and has a rounded pin shape. The contact portion 230A is double plated similar to the aforementioned embodiment (see FIG. 5). In detail, the contact portion 230A has the first plated layer 232 as its outermost layer, the second plated layer 234 located under the first plated layer 232 and the base member 236 located under the second plated layer 234. The first plated layer 232 is made of silver or silver alloy and has Vickers hardness not more than 90 Hv. The second plated layer 234 is made of silver or silver alloy and has Vickers hardness not less than 100 Hv.

As shown in FIGS. 6 and 7, the mating contact 320A according to the present embodiment has a plurality of divided mating contact points 340A and a base portion 360A. According to the present embodiment, the number of the mating contact points 340A is four. Each of the mating contact points 340A is located in the vicinity of an end of the mating contact 320A. This mating contact point 340A is plated similar to the aforementioned contact portion 230A.

As can be seen from FIG. 7, when the contact 220A is not inserted in the mating contact 320A, the mating contact point 340A is slightly closer toward the center of the mating contact 320A in the YZ-plane. When the connector (not shown) and the mating connector (not shown) are mated with each other, the mating contact point 340A of the mating contact 320A slides on the contact portion 230A of the contact 220A. According to the present embodiment, similar to the aforementioned first embodiment, preferable properties can be obtained.

In the aforementioned first and second embodiments, the mating direction along which the connector and the mating connector are mated with each other is same as a sliding direction along which the mating contact point slides on the contact portion. However, the present invention is not limited thereto. The sliding direction may be different from the mating direction.

EXAMPLES

Hereafter, explanation is made further specifically about the plated structure of the contact portion 230 and 230A according to the aforementioned embodiments of the present invention as referring to Examples and Comparative Examples.

Figure 8:
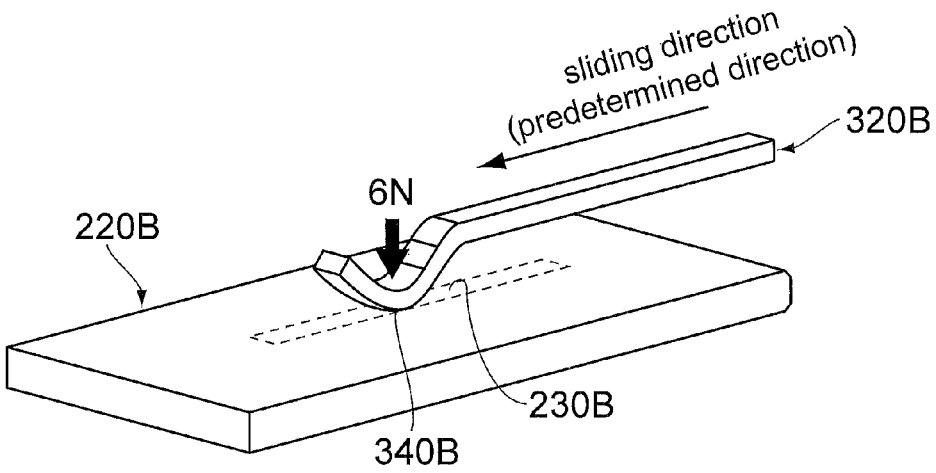
FIG. 8 is a perspective view schematically showing a part of a contact and a part of a mating contact according to examples of the present invention.

As shown in FIG. 8, a contact 220B is a pin contact having a contact portion 230B of a plate-like shape, and a mating contact 320B is a socket contact having a mating contact point 340B of a projecting shape. When the mating contact point 340B is forced to slide on the contact portion 230B and is stopped at a final position, electrical connection between the mating contact point 340B and the contact portion 230B is made. At that time, the mating contact point 340B receives a spring force, specifically a constant vertical load of 6N. Hereafter, this spring force, or the constant vertical load, is referred to as "contact force".

In order to validate effect of the present invention, each of the mating contact point 340B and the contact portion 230B of Examples was provided with a double layered plate which consisted of a hard plated layer (lower layer) and a soft plated layer (upper layer) formed on the hard plated layer. In addition, each of the mating contact point 340B and the contact portion 230B of Comparative Examples was provided with a single layered plate.

More specifically, plated silver of Hv80, plated silver of Hv120, plated silver of Hv150 and plated silver of Hv200 were used as plated layers. Table 1 below shows surface hardness and cross-sectional hardness of each of the plated layers. The surface hardness is Vickers hardness which was measured by pressing an indenter into a surface of the plated layer. The cross-sectional hardness is Vickers hardness which was measured by pressing the indenter into a cross-section of the plated layer. In detail, the surface hardness of the lower layer was measured after the formation of the lower layer and before the formation of the upper layer. The surface hardness of the upper layer was measured after the formation of the upper layer on the lower layer. Each of the plated layers had thickness of 10 μm. Applied load of the indenter in the measurement of hardness was $9.8\times10^{-3}$N (i.e. 1 gf).

TABLE 1

| | Hv80/Hv120 | | Hv80/Hv150 | | Hv80/Hv200 | |
|---|---|---|---|---|---|---|
| | upper layer Hv80 | lower layer Hv120 | upper layer Hv80 | lower layer Hv150 | upper layer Hv80 | lower layer Hv200 |
| Surface Hardness | 79.4 Hv | 122.1 Hv | 78.5 Hv | 151.9 Hv | 87.4 Hv | 190.4 Hv |
| Cross-Sectional Hardness | 73.6 Hv | 159.5 Hv | 81.9 Hv | 182.2 Hv | 69.0 Hv | 200.6 Hv |

Moreover, crystallite size was measured for each of the aforementioned plated layers by using X-ray diffraction apparatus, namely, RINT-2000 of Rigaku Corporation. In this measurement, a measuring angle was 5° to 90°, and a wavelength of measuring X-ray ($CuK_{\alpha 1}$) was $1.54056\times10^{-10}$ m. For calculation of the crystallite size, diffraction lines in (220) plane were used because of their relatively large peak. The measurements are shown in Table 2 below.

TABLE 2

| | Hv80 | Hv120 | Hv150 | Hv200 |
|---|---|---|---|---|
| Crystallite Size | 49.0 nm | 19.6 nm | 17.8 nm | 13.1 nm |

As can be seen from Table 2, the crystallite size is smaller as the Vickers hardness is higher.

Figure 9:
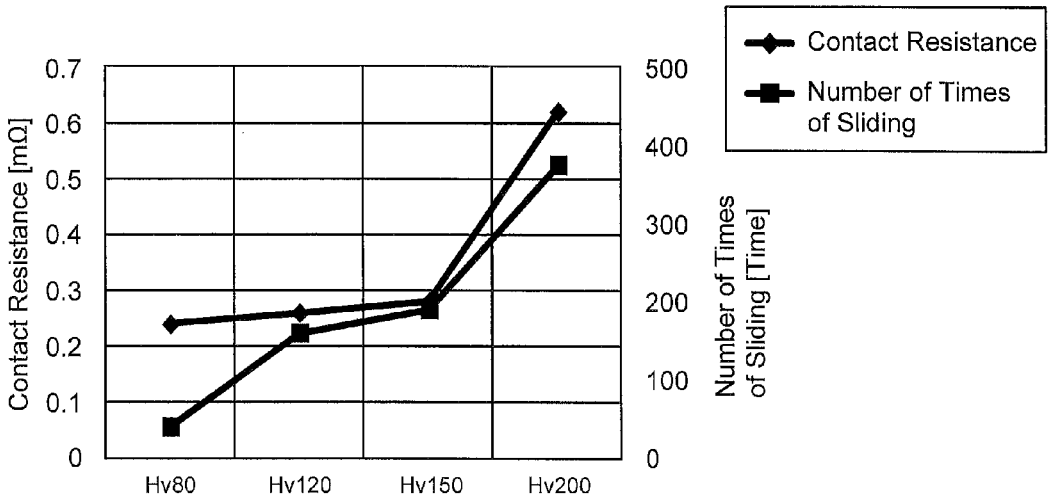
FIG. 9 is a view of graphs showing a relation between contact resistance and number of times of sliding until exposure of a base member, wherein mating contact points and contact portions, each of which is plated with single layered silver having thickness of 10 μm, are used as examples, and the mating contact points as well as the contact portions have various hardness.
Figure 10:
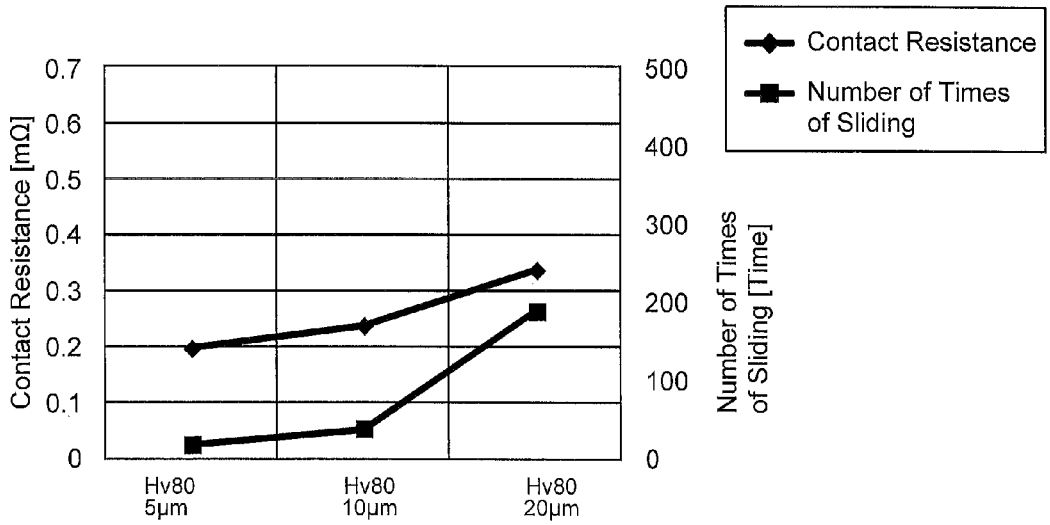
FIG. 10 is a view of graphs showing another relation between the contact resistance and the number of times of sliding until exposure of the base member, wherein soft silver plates having various thickness are used as examples.
Figure 11:
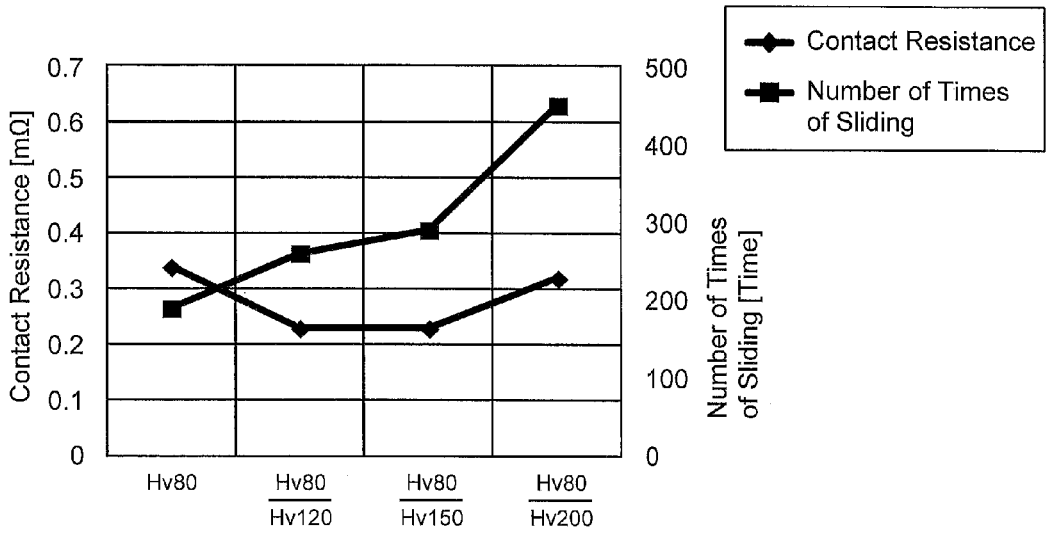
FIG. 11 is a view of graphs showing still another relation between the contact resistance and the number of times of sliding until exposure of the base member, wherein double layered plates are used as examples while a single layered plate is used as a comparative example.
Figure 12:
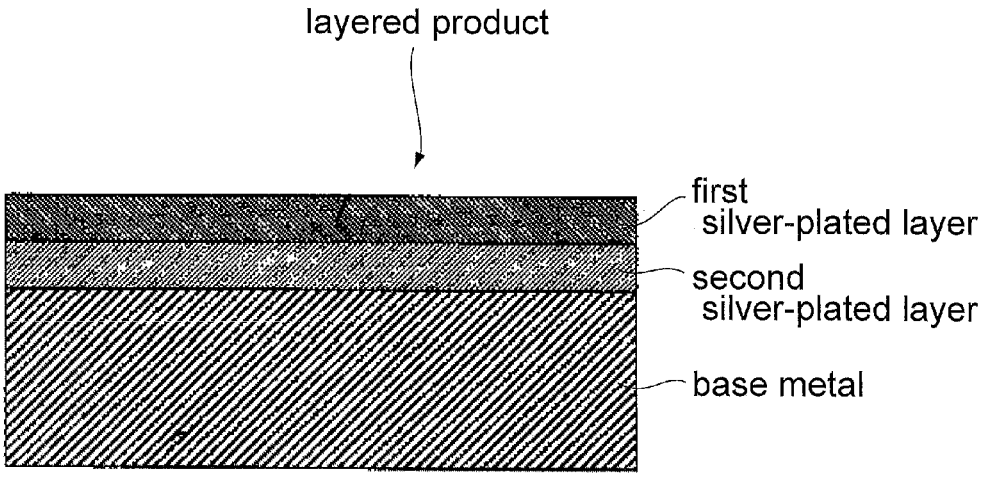
FIG.12 PRIOR ART
FIG. 12 is a cross-sectional view showing a layered product of Patent Document 1.

Measurement was performed about contact resistance between the contact 220B and the mating contact 320B, wherein each of the contact 220B and the mating contact 320B is formed with the aforementioned plated layer. Referring to FIG. 8, the contact resistance was measured after the mating contact point 340B was made slide on the contact portion 230B by 10 mm in a state where the contact force of 6N was applied. Moreover, the sliding was repeatedly performed until the copper of the base member of the contact portion 230B was exposed, wherein the number of times of sliding was incremented by one for each reciprocating-sliding in a distance of 10 mm. The measurements are shown in FIGS. 9 to 11. In particular, the single layered plated layer of Comparative Example of FIG. 11 had thickness of 20 μm, and each plated layer of the double plated layer of Example of FIG. 11 had thickness of 10 μm.

Referring to FIG. 9, it can be seen that abrasion resistance is higher, or the number of times of sliding for exposure of the copper of the base member is larger, as the plated layer is harder, while the contact resistance is also higher as the plated layer is harder. Moreover, referring to FIG. 10, it can be seen that the base member is more hardly to be exposed as the thickness of the plated layer is thicker, while the contact resistance is higher as the thickness of the plated layer is thicker. Referring to FIG. 11, it can be seen that, in comparison with the single layered soft plate, the double layered plate has lower contact resistance and higher abrasion resistance, or the number of times of sliding for exposure of the base member thereof is larger.

Note that the silver alloy of the present invention does not include silver-tin alloy. As shown in Table 3 below, the silver-tin alloy has larger number of times of sliding for exposure of the base member because of its high surface hardness and therefore has superior abrasion resistance. However, the silver-tin alloy tends to have high surface resistance because the tin is combined with oxygen in the air to form oxide on the surface thereof. Accordingly, the silver-tin alloy is used neither for the first plated layer 232 nor the second plated layer 234 of the present invention.

TABLE 3

| | Surface Hardness [Hv] | Friction Coefficient | Contact Resistance [mΩ] | Number of Times of Sliding [Time] |
|---|---|---|---|---|
| silver-tin | 257.4 | 0.5 | 1.10 | 745 |
| soft silver (Hv80) | 74.5 | 1.1 | 0.24 | 40 |
| hard silver (Hv200) | 209.2 | 0.8 | 0.61 | 410 |

The present application is based on a Japanese patent application of JP2014-136009 filed before the Japan Patent Office on Jul. 1, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector joinable with a mating connector which includes a mating contact having a mating contact point, wherein:

the connector comprises a contact and a holding member which holds the contact;

the contact has a contact portion and a base member, the base member being made of copper or alloy;

when the connector and the mating connector are mated with each other, the mating contact point slides on and is in contact with the contact portion;

the contact portion has a first plated layer as its outermost layer and a second plated layer located under the first plated layer, the second plated layer being formed on the base member;

the first plated layer is made of silver or silver alloy and has Vickers hardness not more than 90 Hv; and the second plated layer is made of silver or silver alloy and has Vickers hardness not less than 100 Hv.

2. The connector as recited in claim 1, wherein the second plated layer contains silver of 90 wt % or more.

3. The connector as recited in claim 2, wherein the second plated layer further contains, as a remaining part other than the silver, at least one element selected from the group consisting of Sb, Se and Te.

4. The connector as recited in claim 1, wherein the Vickers hardness of the second plated layer is not more than 180 Hv.

5. The connector as recited in claim 1, wherein:

when the connector and the mating connector are mated with each other, the mating contact point slides on the contact portion along a predetermined direction; and the mating contact point has a shape which projects toward the contact portion in a direction intersecting with the predetermined direction.

* * * * *